US008205861B2

(12) United States Patent
Hsu

(10) Patent No.: US 8,205,861 B2
(45) Date of Patent: Jun. 26, 2012

(54) CARRYING RACK OF AN ENGINE

(76) Inventor: Kun-Shan Hsu, Chiayi (TW)

( * ) Notice: Subject to any disclaimer, the term of this patent is extended or adjusted under 35 U.S.C. 154(b) by 369 days.

(21) Appl. No.: 12/689,305

(22) Filed: Jan. 19, 2010

(65) Prior Publication Data

US 2011/0175044 A1 Jul. 21, 2011

(51) Int. Cl.
*B66F 3/24* (2006.01)
*B66F 3/36* (2006.01)
*B66F 3/42* (2006.01)

(52) U.S. Cl. ..... 254/93 H; 254/93 R; 254/133 R; 254/134

(58) Field of Classification Search ..... 254/93 R, 254/93 H, 134, 8 B
See application file for complete search history.

(56) References Cited

U.S. PATENT DOCUMENTS 5,033,717 A * 7/1991 Symon ..... 254/8 B
5,190,265 A * 3/1993 Barry et al. ..... 254/8 B
5,251,875 A * 10/1993 Craychee et al. ..... 254/8 B
5,961,098 A * 10/1999 Loan ..... 254/133 R
6,189,864 B1 * 2/2001 Crow et al. ..... 254/8 B
6,581,908 B1 * 6/2003 Francis ..... 254/2 B
6,763,562 B2 * 7/2004 Barrios et al. ..... 29/274
2003/0089895 A1 * 5/2003 Barrios et al. ..... 254/134
2011/0175044 A1 * 7/2011 Hsu ..... 254/93 R
2012/0049141 A1 * 3/2012 Hsu ..... 254/93 R

* cited by examiner

*Primary Examiner* — Lee D Wilson
*Assistant Examiner* — Jamal Daniel
(74) *Attorney, Agent, or Firm* — Alan Kamrath; Kamrath IP Lawfirm, PA

(57) ABSTRACT

A carrying rack of an engine includes a main hydraulic cylinder to move a swing arm upward and downward, and the swing arm including a seat disposed on a front end thereof, the seat including a support post axially mounted therein, wherein the support post includes a fixed peg axially inserted to a U-shaped receiving member to form a L shape, and the receiving member includes a pillar axially fixed on a bottom end thereof by using a retaining bolt, the support post also includes a rotating holder axially connected to the seat; an auxiliary hydraulic cylinder is axially disposed in an inner side of the swing arm by using its distal end so that a hydraulic lifter axially couples with the rotating holder via a connecting rod, and the swing arm includes a shaft mounted thereon to contact with the connecting rod.

3 Claims, 6 Drawing Sheets

CARRYING RACK OF AN ENGINE

BACKGROUND OF THE INVENTION

1. Field of the Invention

The present invention relates to a carrying rack of an engine which is capable of facilitating disassembly of the supporting member based on a height of the engine and enhancing operating safety.

2. Description of the Prior Art

Conventional carrying rack is a lifting structure to be used to disassemble and assemble a vehicle engine, therefore it is an essentially auxiliary equipment during vehicle maintaining process. To facilitate lifting and disassembling engine, a hydraulic jack is used to lift a swing arm of a hydraulic cylinder so that a support post axially connected to a seat is fixed to the engine to move upward and downward, however such a conventional lifting method is only used to control the swing arm to move upward and downward, accordingly when the support post inserts to the supporting member from a horizontal position to be disassembled, the swing arm can only be lowered to a suitable height but can not be swung to a vertical position to facilitate maintenance. Therefore, the support post has to be rotated toward a 90 degree of vertical position manually, thus causing danger if the support post swings or falls, and user injures easily because of improper force.

The present invention has arisen to mitigate and/or obviate the afore-described disadvantages.

SUMMARY OF THE INVENTION

The primary object of the present invention is to provide a carrying rack of an engine which is capable of facilitating disassembly of the supporting member based on a height of the engine and enhancing operating safety, wherein when the carrying rack is lowered, the support post is operated by the auxiliary hydraulic cylinder to swing back to a 90 degree of vertical position without falling.

A carrying rack of an engine in accordance with a preferred embodiment of the present invention comprises a main hydraulic cylinder to move a swing arm upward and downward, and the swing arm including a seat disposed on a front end thereof, the seat including a support post axially mounted therein, wherein the support post includes a fixed peg axially inserted to a U-shaped receiving member to form a L shape, and the receiving member includes a pillar axially fixed on a bottom end thereof by using a retaining bolt, the support post also includes a rotating holder axially connected to the seat;

an auxiliary hydraulic cylinder is axially disposed in an inner side of the swing arm by using its distal end so that a hydraulic lifter axially couples with the rotating holder via a connecting rod, and the swing arm includes a shaft mounted thereon to contact with the connecting rod.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
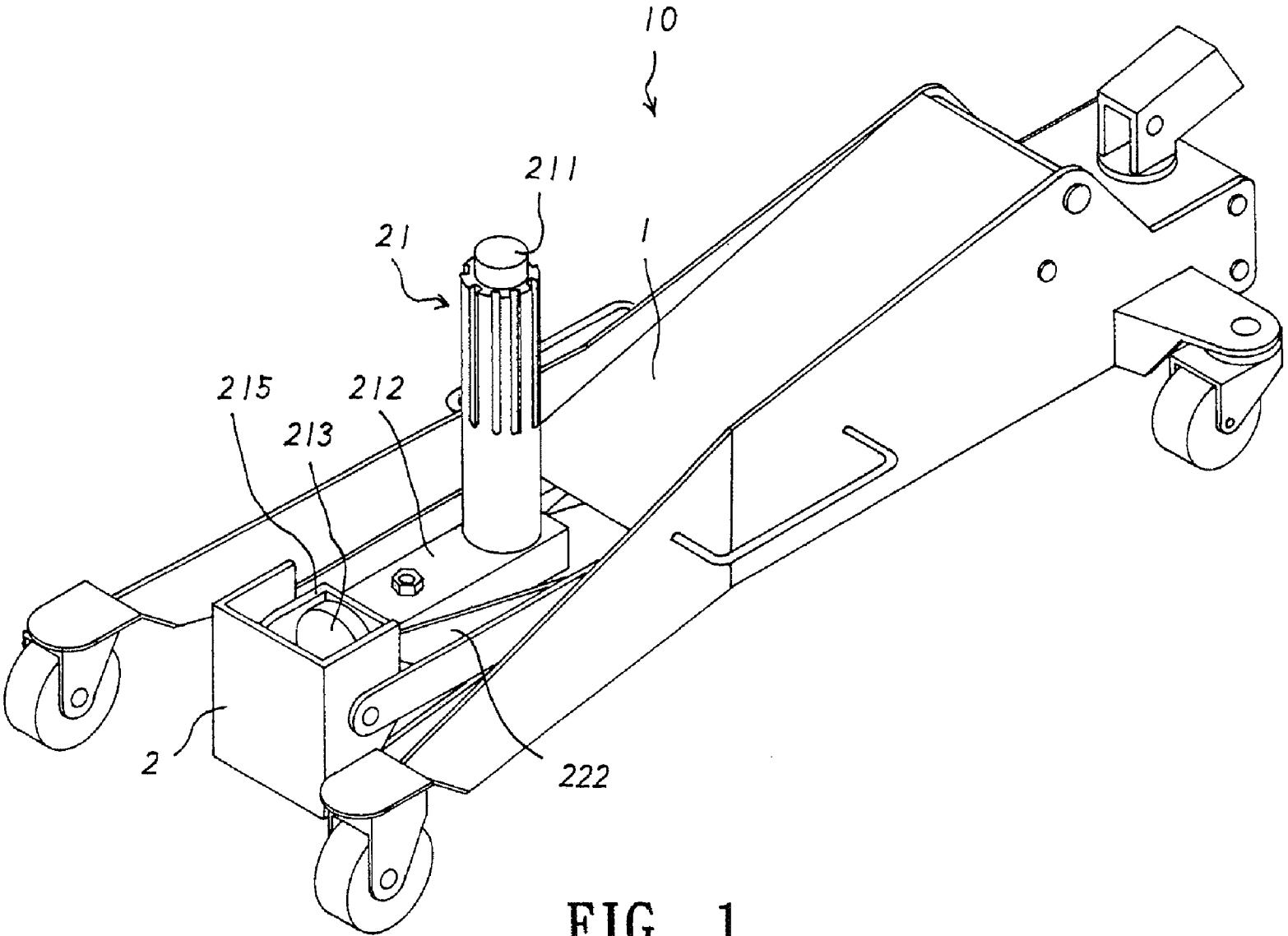
FIG. 1 is a perspective view showing the assembly of a carrying rack of an engine according to a preferred embodiment of the present invention.
Figure 2:
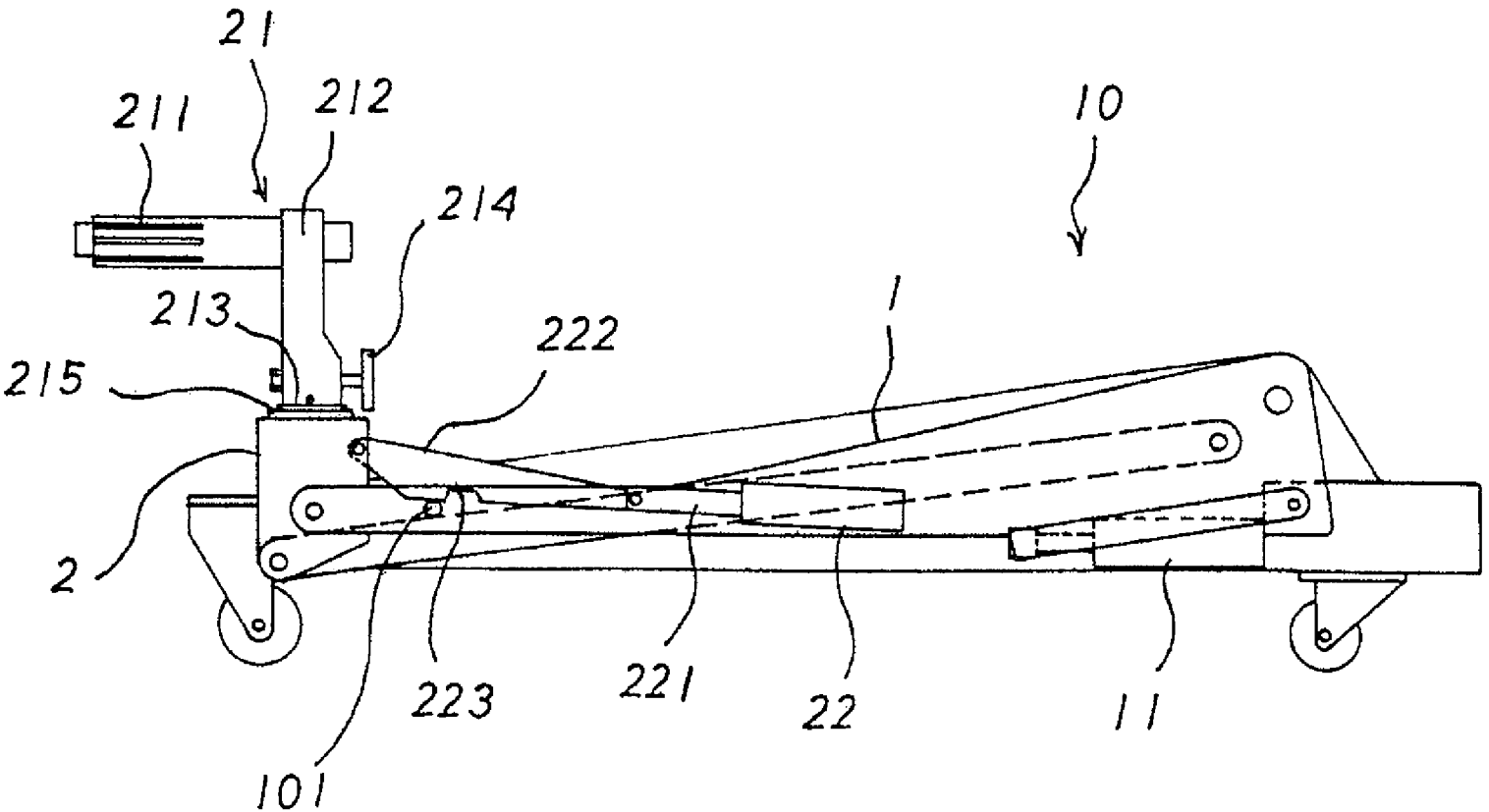
FIG. 2 is a side plan view showing the assembly of the carrying rack of the engine according to the preferred embodiment of the present invention.

A carrying rack 10 of an engine according to a preferred embodiment of the present invention includes a main hydraulic cylinder 11 to move a swing arm 1 upward and downward (as shown in FIGS. 1 and 2), and the swing arm 1 includes a seat 2 disposed on a front end thereof, the seat 2 includes a support post 21 axially mounted therein, wherein the support post 21 includes a fixed peg 211 axially inserted to a U-shaped receiving member 212 to form a L shape, and the receiving member 212 includes a pillar 213 axially fixed on a bottom end thereof by using a retaining bolt 214, the support post 21 also includes a rotating holder 215 axially connected to the seat 2;

an auxiliary hydraulic cylinder 22 is axially disposed in an inner side of the swing arm 1 by using its distal end so that a hydraulic lifter 221 axially couples with the rotating holder 215 via a connecting rod 222, and the swing arm 1 includes a shaft 101 mounted thereon to contact with the connecting rod 222.

Figure 3:
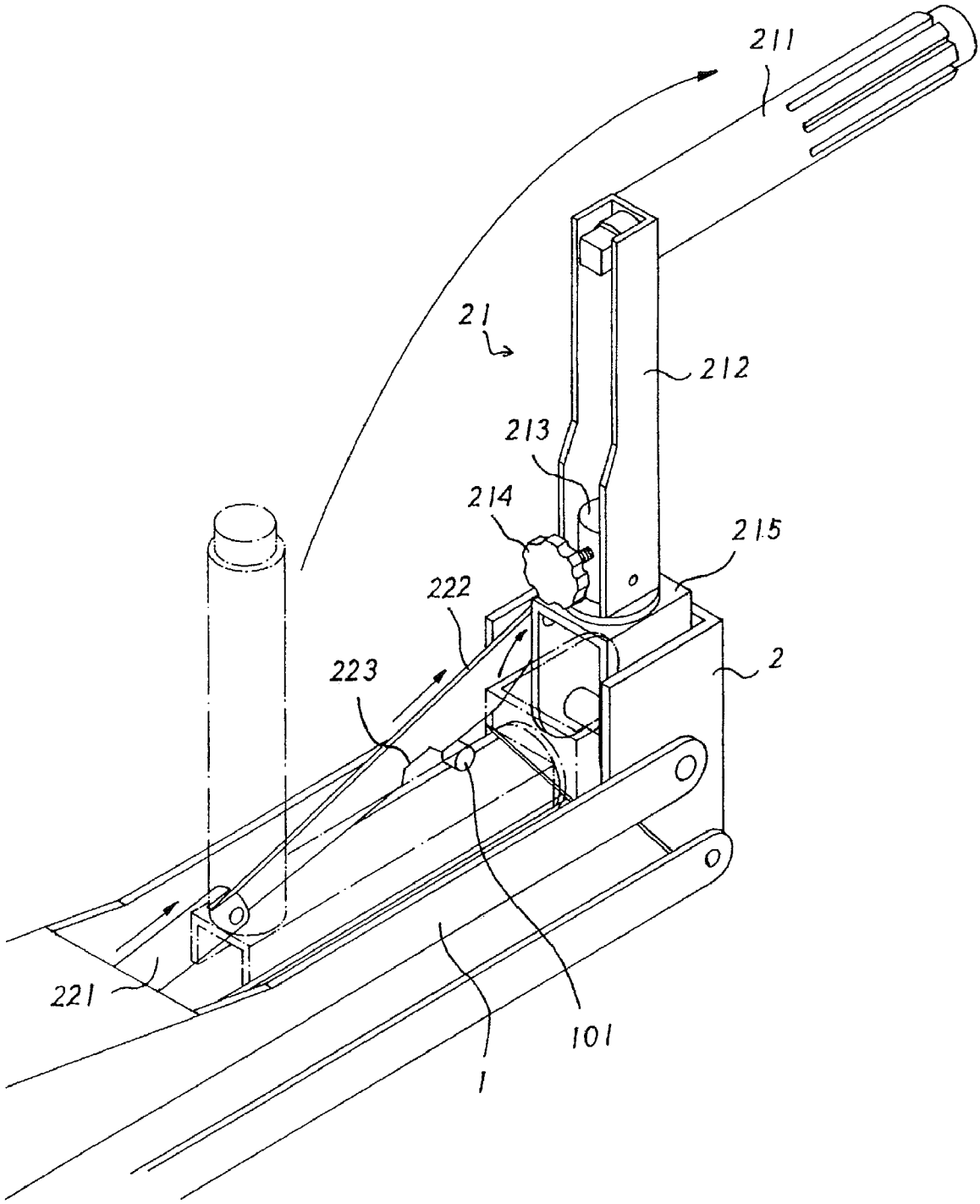
FIG. 3 is a perspective view showing the operation of a support post of the carrying rack of the engine according to the preferred embodiment of the present invention.

By using above-mentioned components, hydraulic oil is inputted by an oil pump from high and low pressured single-direction valves to a piping system of the main and the auxiliary hydraulic cylinders 11, 22, accordingly the hydraulic oil is fed to the auxiliary hydraulic cylinder 22 first so that the hydraulic lifter 221 pushes the connecting rod 222 to slide along the shaft 101, such that the rotating holder 215 swings relative to the seat 2 (as illustrated in FIG. 3), and the fixed peg 211 of the support post 21 swings to a horizontal position from a vertical position, the auxiliary hydraulic cylinder 22 is pushed to a bottommost end of the carrying rack 10 so that a pressure of the hydraulic oil pushes the high pressured single-direction valve of the main hydraulic cylinder 11 open, and the main hydraulic cylinder 11 pushes the swing arm 1 to move upward so that the fixed peg 211 of the support post 21 aligns with the supporting members 3 to be inserted, thus facilitating disassembling and carrying process.

Figure 4:
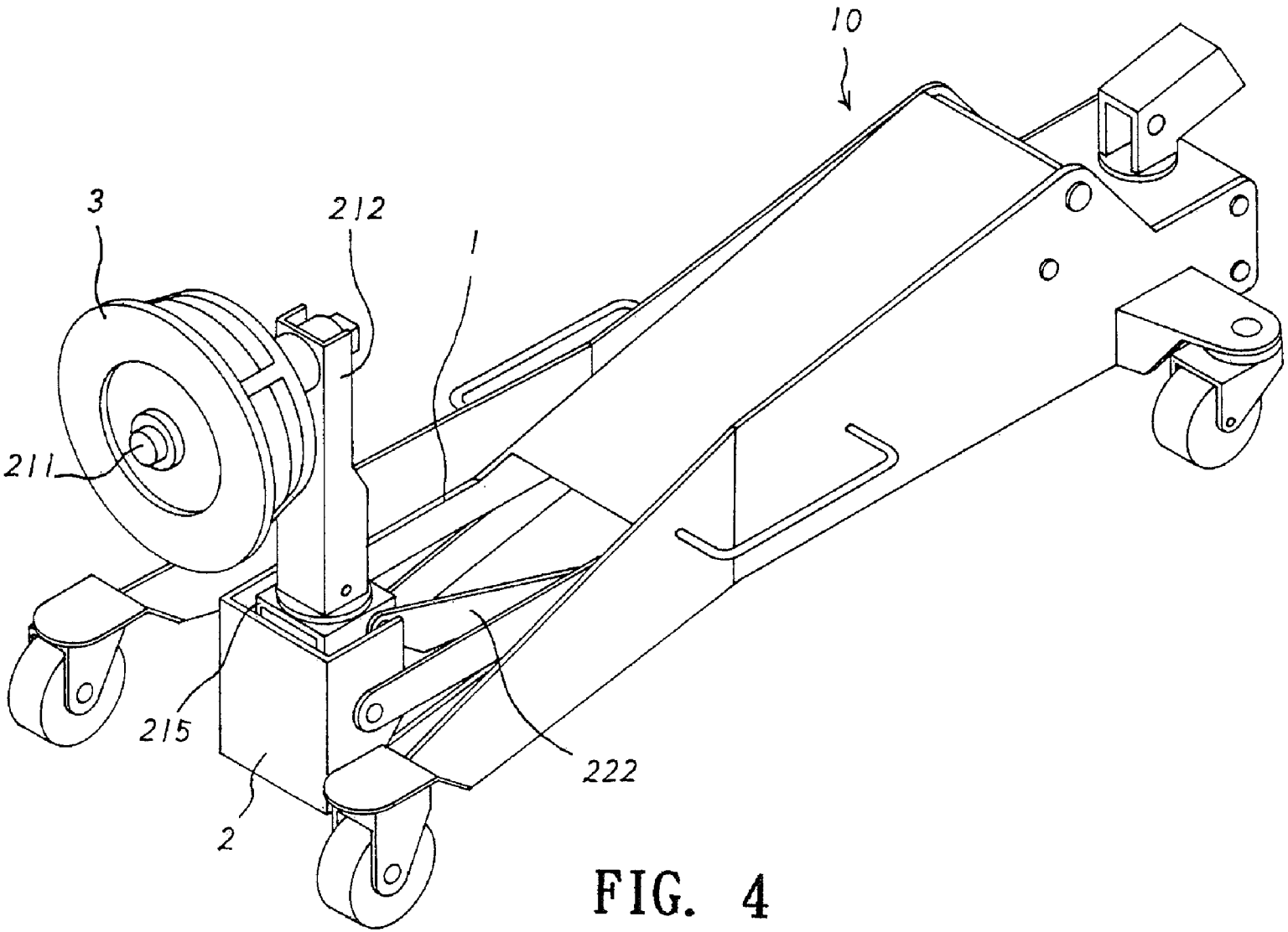
FIG. 4 is a perspective view showing the operation of the carrying rack of the engine according to the preferred embodiment of the present invention.

After releasing the valves of the piping system, the main and the auxiliary hydraulic cylinders 11, 22 start retracting backward so that the swing arm 1 moves downward (as shown in FIG. 4), and the support post 21 to support the supporting member 3 swings backward until the swing arm 1 retracts backward completely, and the fixed peg 211 of the support post 21 returns the vertical position to facilitate maintenance of supporting member 3. Thereby, the support post 21 is controlled by the auxiliary hydraulic cylinder 22 to enhance operating safety without injuring an operator because of swing.

Figure 5:
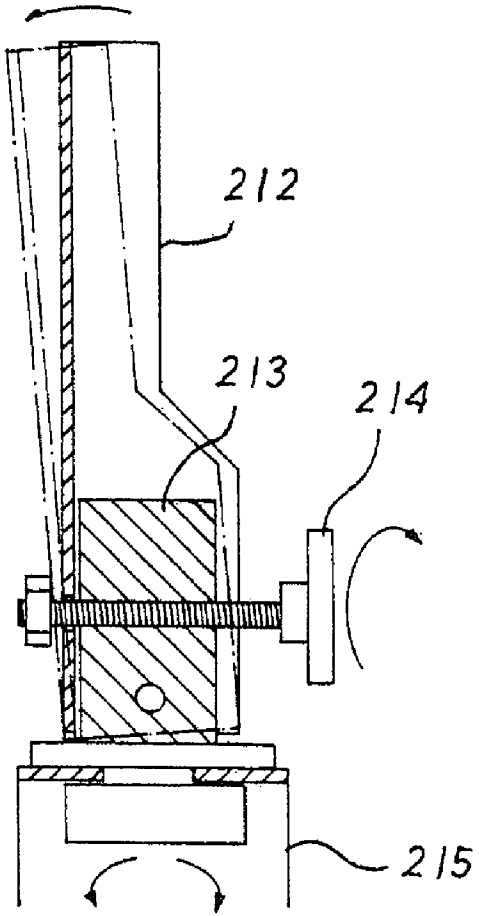
FIG. 5 is a cross sectional view showing the support post being adjusted to a desired angle.

In addition, the bottom end of the U-shaped receiving member 212 of the support post 21 is axially fixed onto the pillar 213 by ways of the retaining bolt 214, and the retaining bolt 214 allows to be released to adjust an angle between the U-shaped receiving member 212 and the pillar 213 (as illustrated in FIG. 5) to change a relative angle of the fixed peg 211 so as to correspond to the supporting member 3, thereby disassembling and assembling the supporting member 3 conveniently.

Figure 6:
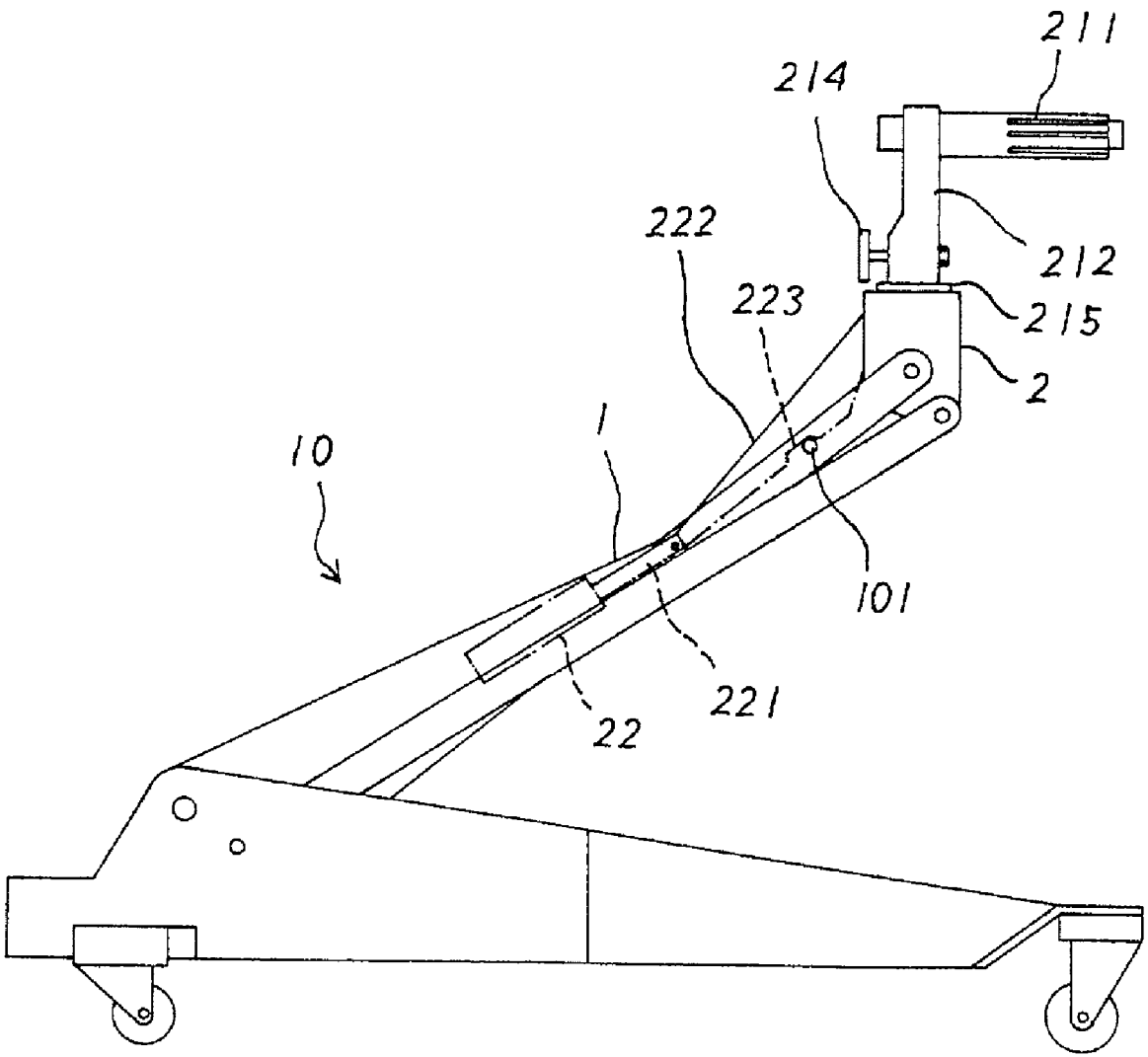
FIG. 6 is a side plan view showing the operation of the carrying rack of the engine according to the preferred embodiment of the present invention.

Likewise, the connecting rod 222 is designed as a tilted plate facing to the rotating holder 215, and includes a slot 223 disposed therein to correspond to a highest position where the swing arm 1 moves upward so as to receive the sliding shaft 101 (as illustrated in FIG. 6), obtaining an auxiliary positioning function to enhance operating safety.

While we have shown and described various embodiments in accordance with the present invention, it is clear to those skilled in the art that further embodiments may be made without departing from the scope of the present invention.

What is claimed is:

1. A carrying rack of an engine comprising a main hydraulic cylinder to move a swing arm upward and downward, and the swing arm including a seat disposed on a front end thereof, the seat including a support post axially mounted therein, wherein the support post includes a fixed peg axially inserted to a U-shaped receiving member to form a L shape, and the receiving member includes a pillar axially fixed on a bottom end thereof by using a retaining bolt, the support post also includes a rotating holder axially connected to the seat;

an auxiliary hydraulic cylinder is axially disposed in an inner side of the swing arm by using its distal end so that a hydraulic lifter axially couples with the rotating holder via a connecting rod, and the swing arm includes a shaft mounted thereon to contact with the connecting rod.

2. The carrying rack of an engine as claimed in claim 1, wherein the retaining bolt allows to be released to adjust an angle between the U-shaped receiving member and the pillar to change a relative angle of the fixed peg.

3. The carrying rack of an engine as claimed in claim 1, wherein the connecting rod is designed as a tilted plate facing to the rotating holder, and includes a slot disposed therein to correspond to a highest position where the swing arm moves upward so as to receive the sliding shaft.

* * * * *